United States Patent [19]

Kubota et al.

[11] Patent Number: 4,708,455

[45] Date of Patent: Nov. 24, 1987

[54] IMAGE FORMING APPARATUS AND A PROCESS UNIT FOR USE IN THE SAME

[75] Inventors: Atsushi Kubota, Machida; Shinnosuke Taniishi, Kawasaki; Shinichi Sasaki, Fujisawa; Akiyoshi Kimura, Tokyo; Michiro Koike, Kawasaki, all of Japan

[73] Assignee: Canon Kabushiki Kaisha, Tokyo, Japan

[21] Appl. No.: 828,734

[22] Filed: Feb. 12, 1986

Related U.S. Application Data

[62] Division of Ser. No. 533,650, Sep. 19, 1983.

[30] Foreign Application Priority Data

| | | | |
|---|---|---|---|
| Sep. 30, 1982 | [JP] | Japan | 57-171903 |
| Mar. 10, 1983 | [JP] | Japan | 58-39643 |
| Jul. 5, 1983 | [JP] | Japan | 58-122045 |

[51] Int. Cl.[4] ..... G03G 15/00

[52] U.S. Cl. ..... 355/3 R; 355/3 DR

[58] Field of Search ..... 355/3 R, 3 DR, 3 CH, 355/3 DD, 67, 133

[56] References Cited

U.S. PATENT DOCUMENTS

| | | | |
|---|---|---|---|
| 3,724,942 | 4/1973 | Gibson et al. . | |
| 3,736,053 | 5/1973 | Shreeve et al. . | |
| 3,770,345 | 11/1973 | Kawakubo et al. . | |
| 3,985,436 | 10/1976 | Tanaka et al. . | |
| 4,148,581 | 4/1979 | Tsuda . | |
| 4,165,168 | 8/1979 | Baumann . | |
| 4,236,807 | 12/1980 | Kuehnle . | |
| 4,254,202 | 3/1981 | Matsumoto et al. . | |
| 4,327,992 | 5/1982 | Babicz . | |
| 4,386,836 | 6/1983 | Hirabayashi et al. . | |
| 4,432,632 | 2/1984 | Yokota . | |
| 4,462,677 | 7/1984 | Onoda | 355/3 R |
| 4,470,689 | 9/1984 | Nomura . | |
| 4,523,831 | 6/1985 | Yokoo et al. . | |

FOREIGN PATENT DOCUMENTS

| | | |
|---|---|---|
| 0092689 | 11/1983 | European Pat. Off. . |
| 0101325 | 2/1984 | European Pat. Off. . |
| 56-88243 | 7/1981 | Japan . |
| 1589055 | 5/1981 | United Kingdom . |
| 2115351 | 9/1983 | United Kingdom . |

*Primary Examiner*—R. L. Moses

*Attorney, Agent, or Firm*—Fitzpatrick, Cella, Harper & Scinto

[57] ABSTRACT

An image forming apparatus or a process unit detachably mountable in the main assembly of the image forming apparatus, the process unit including an image bearing member and processing device (including a part or all of the components) which is actable on the image bearing member. In other words, the present invention relates to a process unit detachably mountable in an image forming apparatus, the process unit comprising an image bearing member, discharger actable on the image bearing member and a device for fixing the image bearing member, and the discharger and the fixing device being integrally supported by a supporting member. Moreover, an image forming apparatus characterized by an image bearing member, a supporting member for supporting the image bearing member so that it can be moved in the direction perpendicular to the axis thereof, a member for fixing the image bearing member to the supporting member, discharger actable on the image bearing member, and the fixing member and the discharger are integrally supported by a supporting member.

30 Claims, 22 Drawing Figures

IMAGE FORMING APPARATUS AND A PROCESS UNIT FOR USE IN THE SAME

This is a division of application Ser. No. 533,650 filed Sept. 19, 1983.

BACKGROUND OF THE INVENTION

1. Field of the Invention

The present invention relates to an image forming apparatus or a process unit detachably mountable in the main assembly of the image forming apparatus, the process unit comprising an image bearing member and process means actable on the image bearing member. The process means may include a part or all of the process components.

The image forming apparatus described herein includes an electronic copying machine, a facsimile, a laser beam printer or other apparatus for forming information on an image bearing member.

2. Description of the Prior Art

An image forming apparatus will now be described in connection with an electrophotographic copying machine, for example.

In the conventional electrophotographic copying machines, a periodical maintenance operation is required, such as replacement of a photosensitive member used as an image bearing member, cleaning of a charging wire, replacement and adjustment of various expendables or the like. In addition, such periodical maintenance operations must be made by an expert serviceman. Therefore, the serviceman has to go to the place where the apparatus is installed for each of the maintenance operation. This is cumbersome.

In order to simplify the maintenance, it has recently been proposed to use a unit including various image forming means such as a photosensitive drum, a development device, a cleaner, a discharger and others, as a unit, as described in U.S. Pat. No. 3,985,436. If such a unit it used, the respective image forming components can be replaced at the same time as the unit together with the photosensitive drum is replaced. In such an arrangement, a user himself can simply replace various process components which requires a periodical maintenance servicing, without the aid of any expert. Additionally, if a plurality of such process units containing different colored toners are used, a certain colored image can be formed by the selecting proper one of these process units. Further, if a process unit is replaced by another process unit containing a development device different from that of the former, development means can be changed to be compatible with the image of an original to be copied.

However, if a unit which has been replaced by the user is to be repaired, an expert must effect replacement, positioning and other operations of various components such as the photosensitive member, the cleaner, the development device and others. Therefore, ponderous operations are still remained.

Maintenance including the replacement and positioning of the photosensitive member, the cleaner, the development device and others was cumbersome also in the prior art copying machines which do not have such a process unit.

SUMMARY OF THE INVENTION

It is an object of the present invention to provide an image forming apparatus or process unit in which an image bearing member can easily be replaced.

Another object of the present invention is to provide an image forming apparatus or process unit in which the positional accuracy between the image bearing member and the process means can be improved.

Still another object of the present invention is to provide an image forming apparatus or process unit which can produce a sharp image.

A further object of the present invention is to provide an image forming apparatus or process unit which can prevent damage to the image bearing member or the process unit.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

The present invention will now be described in more detail with reference to the preferred embodiments thereof.

First of all, an electrophotographic copying machine which uses one embodiment of the process unit according to the present invention will be described.

The term "process unit" described herein is intended to mean a unit including a housing member detachably mountable in the main assembly of an electrophotographic system at a predetermined location, the housing member containing an image bearing member such as an electrophotographic type photosensitive member or the like and at least one other process means. The term "process means" is intended to mean the means for acting on the image bearing member in given manner to perform a image forming process, such as a charger actable on the image bearing member which is a photosensitive member or the like, a development device for visualizing electrostatic latent images on the image bearing member, a cleaner for removing the remaining toner on the photosensitive member or others. Moreover, the term "main assembly" of the electrophotographic system is intended to mean the one that is enclosed by an outer casing and includes means for containing and supporting the above process unit, means for carrying transfer material, means for fixing a toner image transferred from the photosensitive member to a transfer material and/or others.

Figure 1:
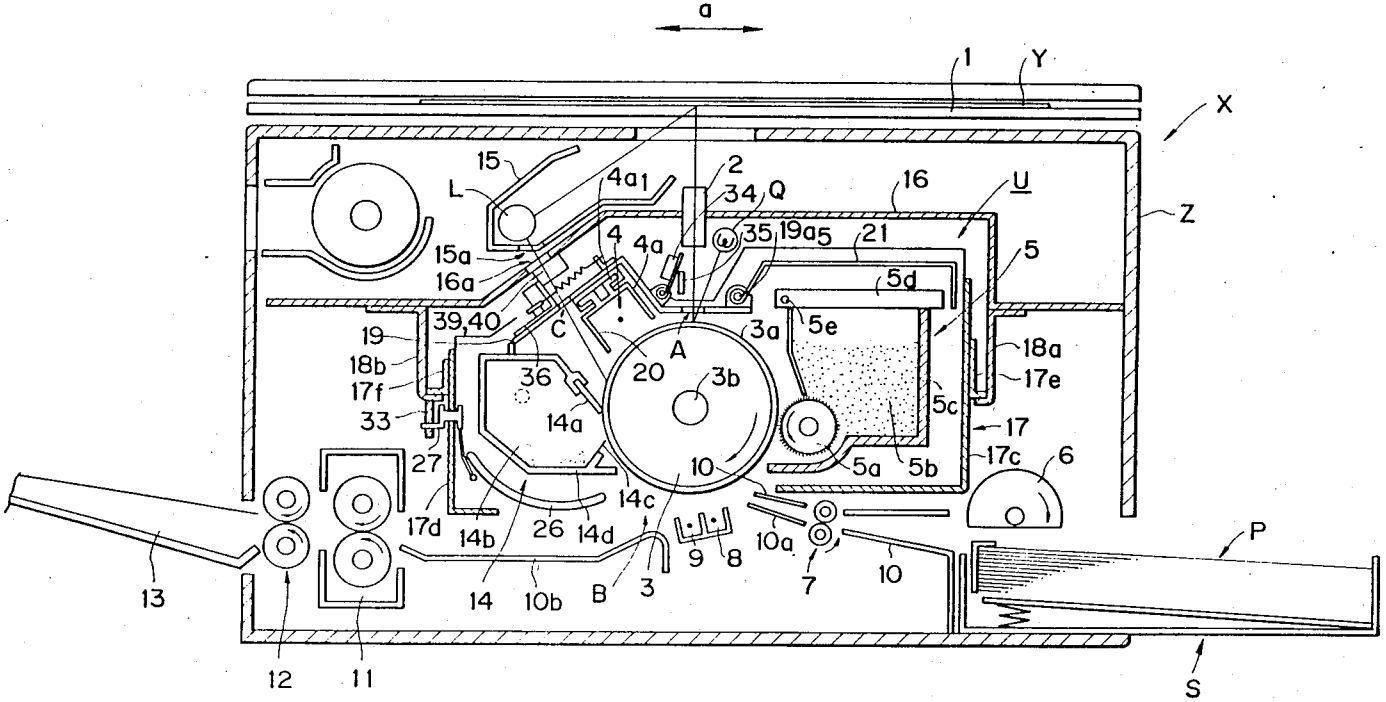
FIG. 1 is a cross-sectional view of a copying machine according to an embodiment of the present invention, in which one embodiment of a process unit according to the present invention is used.

FIG. 1 shows a cross-section of the main assembly X of the copying machine which is enclosed by an outer casing Z. In FIG. 1, reference numeral 1 denotes an original carriage made of a transparent material such as glass and which is located on the top of the main assembly X. The original carriage is adapted to move in the direction of arrow a when an original is to be scanned and to return in the opposite direction after the scan of the original has terminated. Reference numeral 2 designates an imaging optical system comprising an array of plural imaging elements, each having a short focal length and small diameter, such as SELFOC (trademark), bar lens or the like. The imaging optical system is fixed to a plate 16 which is in turn fixedly mounted in the main assembly X. The original Y on the original carriage 1 is irradiated by an illumination lamp L with the resulting reflective light image being projected on an electrophotographic type photosensitive drum 3 by the array 2 through a slit-like aperture A which is formed in the housing of the process unit U. The photosensitive drum 3 is rotated about a shaft 3*b* in the direction shown by the arrow. Reference numeral 4 denotes a charger for uniformly charging a photosensitive layer 3*a* of zinc oxide, selenium or organic photoconductive material which is located around the outer periphery of the photosensitive drum 3. After being uniformly charged by the charger 4, the drum 3 is exposed to said reflected light image through the element array 2 to form an electrostatic latent image. This electrostatic latent image is then visualized by a development device 5 which comprises a magnet roller 5*a* and a toner container 5*b*. The re-supply of toner to the development device 5 can be effected when a lid 5*d* thereon is moved about a shaft 5*e* into its open position. On the other hand, sheets P in a transfer material container S, which is detachably mounted on the main assembly X, are fed one at a time to a transfer station through guides 10 and 10*a* under the action of a feed roller 6 and registration rollers 7. The registration rollers 7 are rotated in synchronism with the movement of image together with the rotation of the photosensitive drum 3. The toner image is transferred from the photosensitive drum 3 onto a sheet P under the action of a transfer discharger 8. Thereafter, the sheet P is separated from the drum 3 under the action of separation means 9 such as a separating belt, separation corona discharger or the like. The separated sheet P is then conducted to a fixation device 11 through a guide 10*b* wherein the toner image is fixed to the sheet P. Thereafter, the sheet P is discharged into a tray 13 under the action of discharge rollers 12. The guides 10, 10*a*, 10*b*, the rollers 6, 7, 12, the transfer discharger 8, the separation means 9 and the fixing device 11 are attached to stay means (not shown) which are fixed and supported on the main assembly X. In other words, the path of sheets P is always provided within the main assembly X. After transfer of the toner image, the remaining toner is removed from the drum 3 by means of a cleaner 14. This cleaner 14 includes a blade 14*a* contacting the drum 3, a used-toner container 14*b* and a scooping sheet 14*c* receiving the used toner which has been removed from the surface of the drum 3 by the blade 14*a*. Subsequently, the drum 3 is irradiated by the lamp L through an opening 15*a* formed in a reflection shade 15 for reflecting the light from the lamp L to the original Y, an opening 16*a* formed in a partition plate 16 dividing the interior of the main assembly X into an upper and lower section and an opening C formed in the housing member of the process unit U, so that any residual charge on the drum surface will be removed. This exposure prior to the sensitizing charge of the charger 4 will be referred to as "pre-exposure". On the other hand, the drum 3 is irradiated by a lamp Q through the aperture A (blank-exposure) before the beginning of the forward movement of the original carriage and during the rearward movement of the same such that any charge applied to the non-imaging area of the drum 3 by the charger 4 will be removed.

Figure 2A:
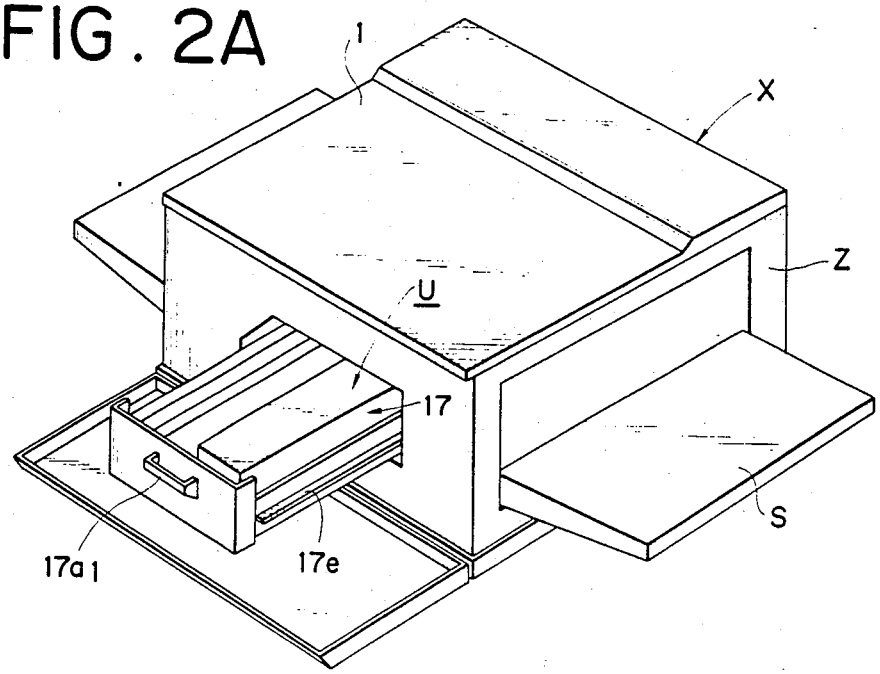
FIGS. 2A and 2B are views illustrating the process unit which is being drawn out of the copying machine.
Figure 2B:
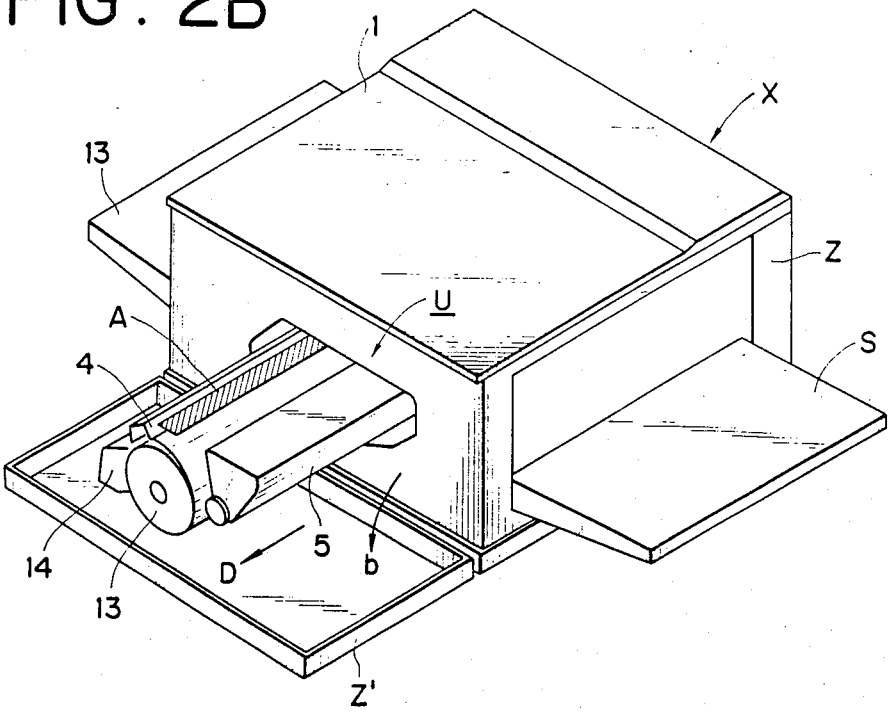
Figure 3:
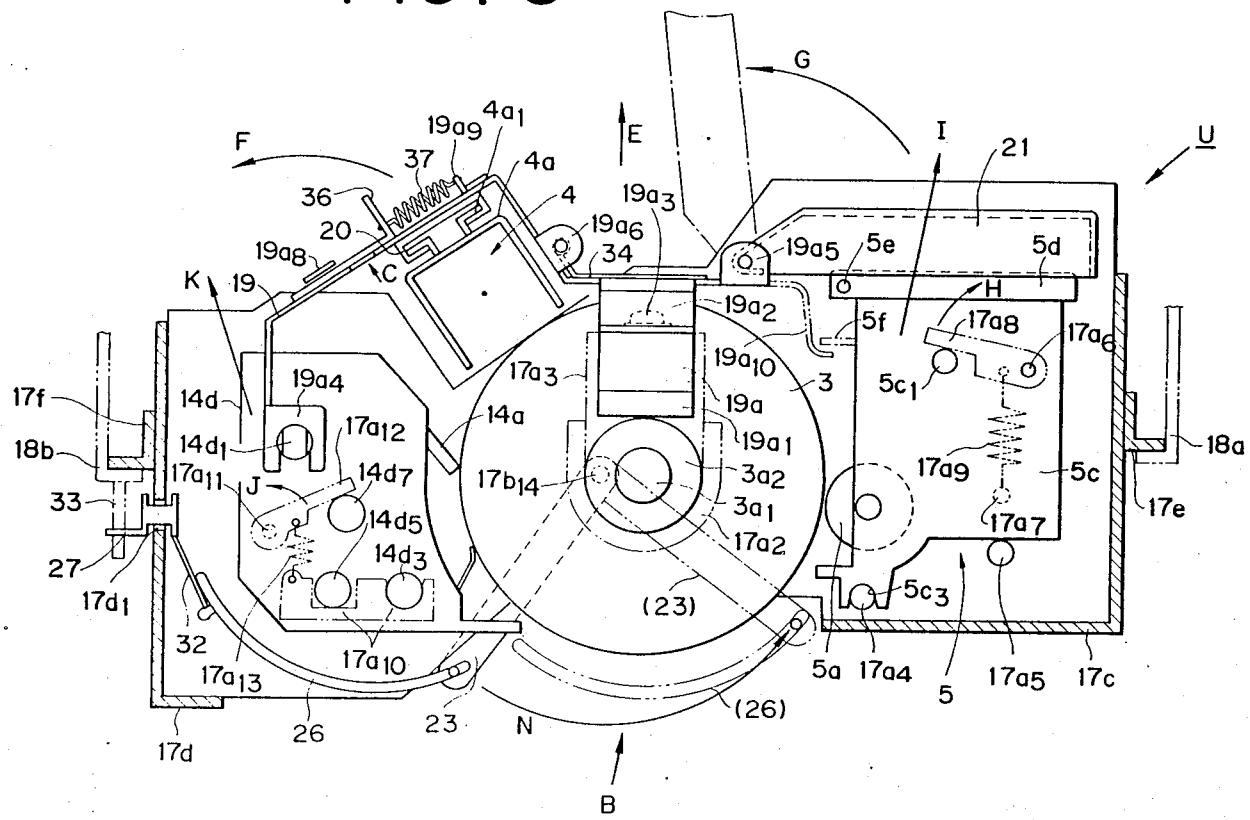
FIG. 3 is a view illustrating the arrangement of image forming means mounted in the process unit.
Figure 4:
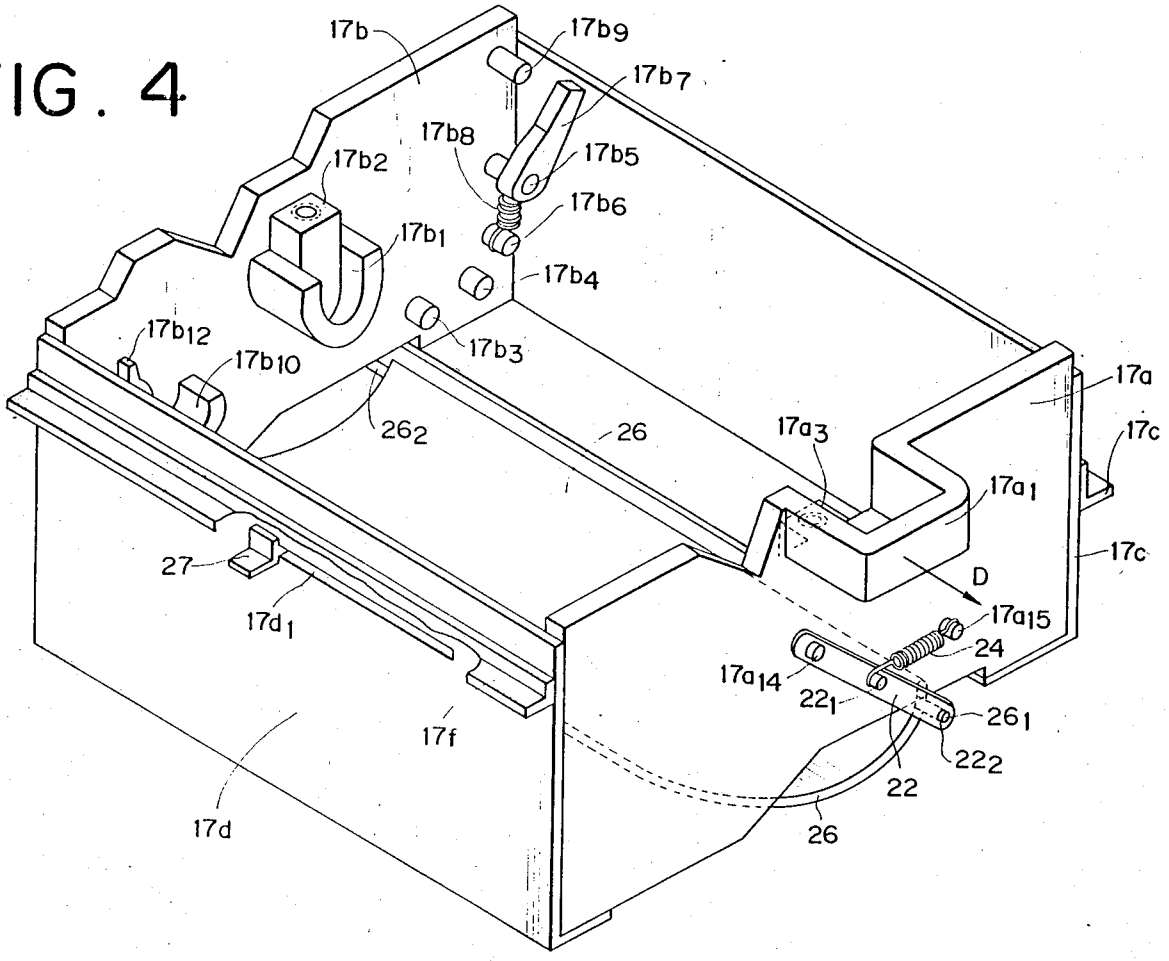
FIG. 4 is a perspective view of the housing of the process unit.

One embodiment of the process unit according to the present invention will now be described with reference to FIGS. 1 to 6. The process unit U mainly comprises a housing or frame member 17 formed of an opaque material such as colored plastics, metal or the like for preventing the photosensitive member from being exposed to external light, and process means contained in the housing 17 and which includes the drum 3, the charger 4, the development device 5 and the cleaner 14. If required, the process unit U may include other process means, for example, a charge removing corona discharger located between the separation corona discharger 9 and the cleaner 14 and so on. Moreover, the process unit U may include at least one process means in addition to the drum. The housing 17 will first be described with reference to FIGS. 1 and 4. FIG. 4 is a perspective view showing the housing 17 from which all the process means are removed. The housing 17 is in the form of a box which is constituted of a front wall 17*a*, a rear wall 17*b* and right and left stays 17*c*, 17*d* connecting the walls 17*a* and 17*b* with each other. The opened top of the box is closed by a charger supporting plate 19 which will be described hereinafter at the left side and by a development device cover 21 at the right side in FIG. 3. The outside of the stay 17*c* or 17*d* is provided with a guide member 17*e* and 17*f* respectively fixed thereto. These guide members 17*e* and 17*f* are slidably placed respectively on positioning guide member 18*a* and 18*b* which are fixedly mounted in the main assembly X of the copying machine. Thus, the process unit U can be positioned and supported in place within the main assembly of the copying machine, that is, at a position in which the photosensitive member and other process means can be actuated to form an image as described hereinbefore. If the process unit U is to be removed from the main assembly of the copying machine, the front casing plate Z' (front door) on the main assembly is opened in the direction b (FIGS. 2A and 2B). The process unit U can be then drawn out of the main assembly along the guide members 18*a* and 18*b* by grasping and pulling a grip $17a_1$ on the front wall 17*a* in the direction shown by arrow D. If it is desired to set the process unit U into the main assembly, the above operation is inversely performed. FIGS. 2A and 2B illustrate the process unit U when it is being removed from or set into the main assembly of the copying machine. In FIG. 2B, the housing 17 is omitted, and only the drum 3, charger 4, development device 5 and cleaner 14 are shown for clarity. After the process unit U has been mounted in place within the main assembly, the front door Z' is lifted in the direction opposite to the direction b to close the main assembly.

How to mount the respective process means on the housing 17 will now be described. First of all, how to mount the charger 4 on the main assembly will be described with reference to FIGS. 1 and 3. FIG. 3 shows the process unit U in such a state that the front wall 17*a* is omitted for clearly illustrating the mounting of the various image forming means. In FIG. 3, positioning and holding members shown by two-dot chain line are located on the front wall 17*a* except the elements $19a_{10}$ and 5*f* which will be described hereinafter. The members shown by two-dot chain line are also provided on the rear wall 17*b* at a position opposed to the front wall 17*a* such that the respective image forming means can be positioned and held relative to the housing 17. In such an arrangement, the charger 4 includes a shield plate 4*a* having a leg portion $4a_1$ which is slidably fitted into and held in a guide 20 provided on the plate-like member 19. The plate-like member 19 holds the charger 4 and defines the upper section of the housing. The member 19 is made of an opaque plastic material such as metal, colored plastics or the like to prevent the photosensitive member from being exposed to external light. If it is wanted to remove the charger 4 from the process unit U, the leg portion $4a_1$ can be disengaged from the guide 20 simply by pulling the charger 4 in the direction of removal of the housing 17 as shown by D in FIG. 4.

Figure 5:
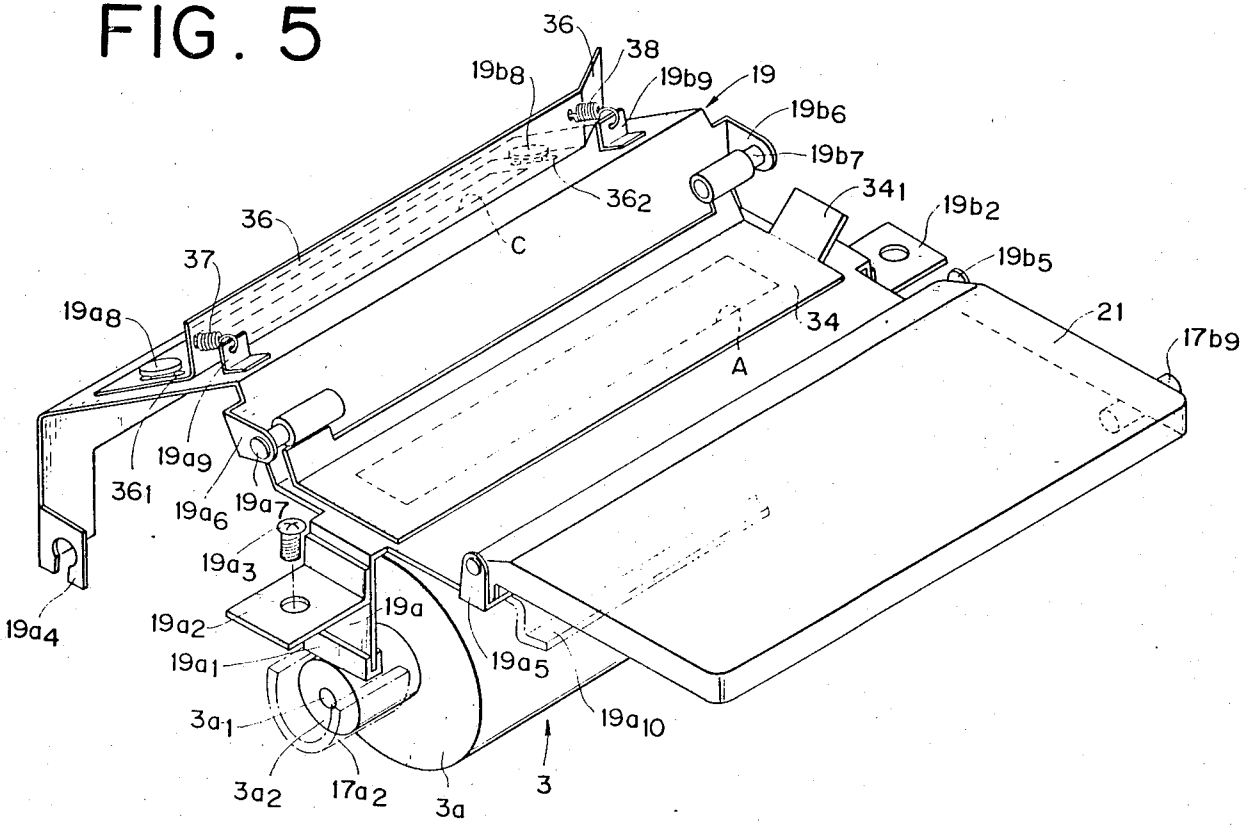
FIGS. 5, 6, 7 and 8 illustrate a light-blocking mechanism for an exposure opening.
Figure 6:
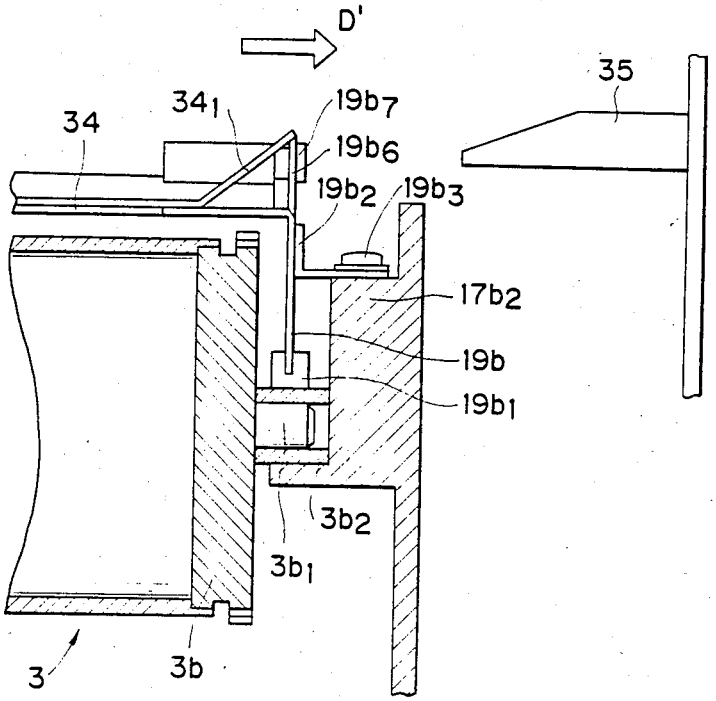

How to mount the drum 3 in the process unit U will be described with reference to FIGS. 3, 4, 5 and 6. FIG. 5 is a perspective view illustrating, together with the drum 3, the exposure apertures A and C closed by the respective light-blocking means. FIG. 6 is a fragmentary cross-section, taken along the longitudinal axis of the drum 3, of means for closing the aperture A used in image exposure and blank exposure. The drum 3 includes flanges 3*a* and 3*b* force-fitted into the opposite ends thereof in the longitudinal axis of the drum. Each of the flanges 3*a* or 3*b* includes a drum positioning shaft $3a_1$ or $3b_1$ fixedly secured thereto at the central axis. The outer periphery of each of the positioning shafts $3a_1$ and $3b_1$ receives a bearing $3a_2$ or $3b_2$ which rotatably supports the respective positioning shaft $3a_1$ or $3b_1$ (FIGS. 5 and 6). On the other hand, the front and rear walls 17*a*, 17*b* of the housing 17 include U-shaped groove portions $17a_2$ and $17b_1$ formed therein, respectively. When the bearings $3a_2$ and $3b_2$ are respectively received in the groove portions $17a_2$ and $17b_1$, the drum 3 is supported in the housing 17 as a whol (FIGS. 3 and 4). The plate-like member 19 is further provided with drum-holding legs 19*a* and 19*b* at positions corresponding to the opposite ends of the central drum axis. Each of the legs 19*a* and 19*b* includes a drum-holding member $19a_1$ or $19b_1$ which is made of an elastomeric material such as rubber or the like. Each of the drum-holding member $19a_1$ and $19b_1$ serves to urge the bearing $3a_2$ or $3b_2$ fitted in the respective groove portion $17a_2$ or $17b_1$ in the downward direction. Each of the drum-holding legs 19*a* and 19*b* is provided with a fixing leg $19a_2$ or $19b_2$ which is fastened on a shoulder portion $17a_3$ or $17b_2$ formed in the front or rear wall (17*a*, 17*b*) of the housing 17 by any suitable fastening means such as screw $19a_3$ or $19b_3$. The whole plate-like member 19 thus defines a part of the housing 17 (FIGS. 3, 4, 5 and 6). In this manner, the drum 3 is downwardly urged by the drum-holding legs $19a_1$ and $19b_1$ such that it is positively held within the housing 17. Further, the flange 3*b* is provided with a gear portion which is adapted to engage with a drive (not shown) on the main assembly X of the copying machine to rotate the drum 3. This gear portion also transmits the power from the drive to the magnet roller 5*a* of the development device 5 in the process unit U. The plate-like member 19 is also provided with support points $19a_4$ and $19b_4$ ($19b_4$ is not shown) which engage with shafts $14d_1$ and $14d_2$ ($14d_2$ is not shown) on the outside of the frame 14*d* of the cleaner 14, respectively. As shown in FIGS. 3 and 5, each of the shafts $14d_1$ and $14d_2$ is in the form of a circular rod which has flat side faces formed therein at diametrical positions. Each of the support point portions $19a_4$ and $19b_4$ has an opening formed therein such that it can detachably be fitted over the corresponding shaft $14d_1$ or $14d_2$ and rotatable relative to the same shaft. By loosening the screws $19a_3$ and $19b_3$, therefore, the plate-like member 19 can be removed from the housing 17 in the direction of arrow E (FIG. 3) when the cleaner or drum is to be removed or replaced and also can be rotated about the shafts $14d_1$ and $14d_2$ in the direction of arrow F when the drum is to be removed or replaced. Upon either of the removal of the plate-like member 19 in the direction of arrow E or the rotation of the same in the direction of arrow F, the plate-like member 19 is retracted from the upper portion of the drum 3 so that the latter can be removed from the housing 17 in the direction of arrow E for replacement.

In the embodiment just mentioned, immediately after the process unit U has be drawn out of the main assembly of the copying machine, the apertures are closed by a mechanism which will be described hereinafter. Subsequently, the photosensitive drum 3 can be removed by loosening the screw $19a_3$ and then rotating the upper plate 19 about the shaft $14d_1$ in the direction of arrow F or by removing the upper plate 19 in the direction of arrow E. The drum 3 is pulled up (in the direction of arrow E) and then stored in a suitable storage container (not shown). In such a manner, the photosensitive drum 3 can very easily be removed from the process unit U in which the apertures A, B and C have been closed. Therefore, the photosensitive drum 3 is expert to external light for a limited time without degradation of the photosensitive drum. After the photosensitive drum 3 has been removed, any external matter will not enter the process unit if the upper plate 19 is moved to its closed position. Even if an ordinary user other than experts effects the replacement of the photosensitive drum, it can be carried out without failure. In addition, the relative position between the drum 3 and the charger 4 can more accurately be obtained since the charger 4 and drum-holding member 19*a* are integrally mounted on the plate-like member 19. The charger 4 used as one of the process means can be positioned based on the shaft 3*b* of the drum.

Now, how to mount the development device 5 on the process unit U will be described with reference to FIGS. 3, 4 and 5.

The development device 5 includes a frame 5C which is detachably placed on shafts $17a_4$, $17b_3$ and $17a_5$, $17b_4$ provided at positions opposed to the front and rear walls 17*a* and 17*b* of the housing 17. There is thus a predetermined gap between the photosensitive member 3 and the roller 5*a* positioned within the housing 17. This gap is formed between the roller 5*a* and the photosensitive member 3 upon engaging the shaft $17a_4$ with a recess $5C_3$ provided on the under surface of the frame 5C at the side of the drum 3 since the development device 5 is mounted in the process unit such that the device 5 tends to pivot clockwise. The frame 5C also includes shafts $5C_1$ and $5C_2$. Although the shaft $5C_2$ is not shown, it is located on the frame 5C at a position opposed to the shaft $5C_1$ on the central axis of the drum. On the other hand, the front and rear walls 17*a*, 17*b* are respectively provided with shafts $17a_6$, $17b_5$ and $17a_7$, $17b_6$ at positions opposed to each other. On the respective shafts $17a_6$ and $17b_5$ there are rotatably mounted levers $17a_8$ and $17b_7$, respectively. Springs $17a_9$ and $17b_8$ are respectively stretched between the levers $17a_8$, $17b_7$ and the shafts $17a_7$, $17b_6$. Therefore, the shafts $5C_1$, $5C_2$ are respectively urged downwardly by the levers $17a_8$, $17b_7$ under the action of the spring $17a_9$, $17b_8$ to positively hold the development device 5 in the housing 17. The top of the development device 5 is closed by a cover 21 which is rotatable about support points $19a_5$ and $19b_5$ on the plate-like member 19 in the direction of arrow G. The cover 21 can bear at one end on a shaft $17b_9$ formed in the rear wall 17*b* so that the cover 21 will not fall into the development device 5. In such an arrangement, the development device 5 can be removed from the housing 17 in the direction of arrow I by rotating and therefore retracting the cover 21 in the direction of arrow G and also by rotating and therefore retracting the levers $17a_5$ and $17b_7$ in the direction of arrow H.

Next, how to mount the cleaner 14 on the process unit U will be described with reference to FIGS. 3 and 4. The cleaner 14 includes a housing 14*d* which includes shafts $14d_3$, $14d_4$ and $14d_5$, $14d_6$ provided on the opposite side walls thereof at positions respectively aligned with one another in the direction of axes which are parallel to the central axis of the drum. The shafts $14d_4$ and $14d_6$ are not shown. These shafts are detachably placed in groove portions $17a_{10}$ and $17b_{10}$ which are respectively formed in the front and rear walls 17*a* and 17*b* of the housing 17. As a result, the cleaner 14 is positioned so as to contact the blade 14*a* thereof with the drum 3. The cleaner housing 14*d* also includes shafts $14d_7$ and $14d_8$ ($14d_8$ is not shown) on the opposite sides thereof at positions aligned with each other. On the other hand, the front and rear walls 17*a* and 17*b* have shafts $17a_{11}$ and $17b_{11}$ ($17b_{11}$ is not shown) provided thereon, respectively. On each of these shafts $17a_{11}$ and $17b_{11}$ there is rotatably mounted a lever $17a_{12}$ or $17b_{12}$. A spring $17a_{13}$ or $17b_{13}$ ($17b_{13}$ is not shown) is stretched between the lever $17a_{12}$ or $17b_{12}$ and the groove portion $17a_{10}$ or $17b_{10}$. The cleaner shafts $14d_7$ and $14d_8$ are downwardly urged respectively by the levers $17a_{12}$ and $17b_{12}$ under the action of the springs $17a_{13}$ and $17b_{13}$ so that the cleaner 14 can positively be held in the housing 17. As in the development device 5, the cleaner 14 can be removed from the housing 17 in the direction of arrow K by rotating and therefore retracting the levers $17a_{12}$ and $17b_{12}$ in the direction of arrow J.

Figure 9:
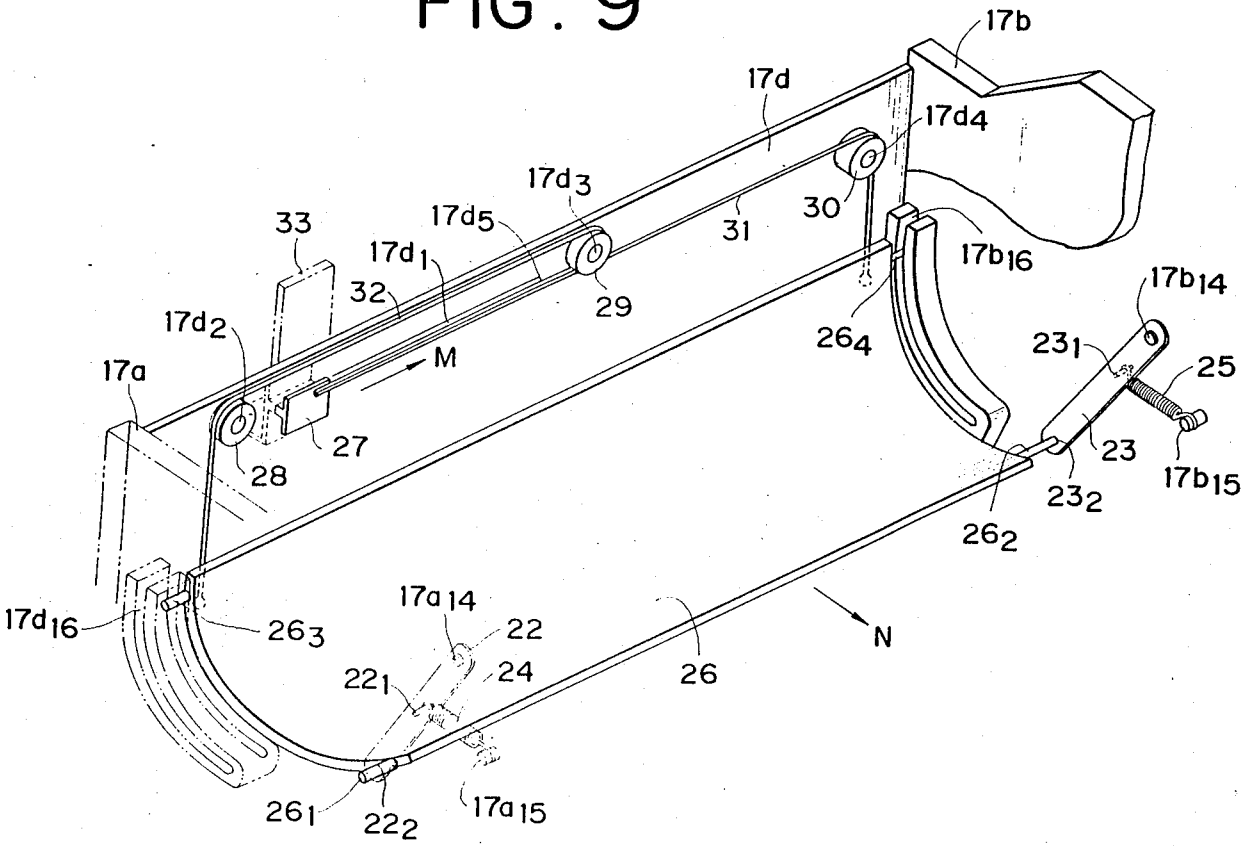
FIG. 9 illustrates another light-blocking mechanism for opening for image transfer.

Although the housing structure of the process unit U and the mounting of the process means have been described, without spcific mentioning, the process unit U includes a transfer aperture B formed therein at the transfer station in which the transfer discharger 8 faces to the drum, in addition to the exposure apertures A and C. When the process unit is removed from the main assembly of the copying machine and if external light penetrates into the process unit U through these apertures, the photosensitive member may adversely be affected by that external light. Therefore, the process unit requires some measures for closing the apertures, which practically require the following: Firstly, such measures must be performed as soon as possible after the process unit has been removed from the main assembly of the copying machine. This is because the affection of external light to the photosensitive member increases as the period in which the photosensitive member is exposed to the external light increases. Secondly, the measures should positively be carried out because an operator may forget to close the apertures if they are manually closed. This means that automatic mechanism for closing the apertures is desired. In view of these requirements, there is provided a light blocking mechanism for closing the exposure and transfer apertures. The light blocking mechanism for the transfer aperture will first be described with reference to FIGS. 3, 4 and 9. In FIG. 3, the light blocking mechanism for closing the transfer aperture B is shown in its closed position, and the positioning members 18*a* and 18*b* on the main assembly of the copying machine are shown by two-dot chain line. FIG. 9 is a perspective view of the light blocking mechanism for the transfer aperture B as viewed from the interior of the housing 17, with the cleaner 14 being omitted for clarity. In FIG. 9, the light blocking mechanism is in its open position. The front wall 17*a* of the housing 17 is shown by two-dot chain line. On the other hand, the closed position of the light blocking mechanism is shown in FIG. 4. On the outsides of the front and rear walls 17*a*, 17*b* in the housing 17 there are provided shafts $17a_{14}$, $17b_{14}$ and $17a_{15}$, $17b_{15}$ formed therein at positions aligned with each other, respectively. Around the shafts $17a_{14}$ and $17b_{14}$ there are rotatably mounted levers 22 and 23 to which shafts $22_1$ and $23_1$ are fixedly secured, respectively. Spring 24 or 25 is stretched between the shaft $22_1$ or $23_1$ and the shaft $17a_{15}$ or $17b_{15}$. Each of the levers 22 and 23 is provided with an opening $22_2$ or $23_2$ into which a pin $26_1$ or $26_2$ is loosely fitted. These pins $26_1$ and $26_2$ extend from a cover 26 of an opaque plastic or metal material for blocking the photosensitive member from external light. Further, the cover 26 has pin $26_3$ and $26_4$ fixed thereto which are slidably guided in arcuate grooves $17a_{16}$ and $17b_{16}$, respectively. These grooves $17a_{16}$ and $17b_{16}$ are formed in the front and rear walls 17*a*, 17*b* of the housing 17, respectively. On the other hand, the left-hand stay 17*d* of the housing 17 includes a guide groove $17d_1$ formed therein in which a slide member 27 is slidably received. The left-hand stay 17*d* fixedly supports shafts $17d_2$, $17d_3$ amd $17d_4$ around which pulleys 28, 29 and 30 are rotatably mounted, respectively. The end of a wire 31 is fastened to the cover 26 at one end. The wire 31 passes around the pulley 30 toward the slide member 27 to which the opposite end of the wire is fixed. The opposite end of the cover 26 fixedly supports one end of a wire 32 which passes around the pulleys 28 and 29 toward the slide member 27 to which the opposite end of the wire 32 is fastened. A member located behind the left-hand stay 17*d* and shown by two-dot chain line in FIG. 9 is a latch member 33 fastened on the positioning member 18*b* as shown in FIG. 3.

The so constructed mechanism for closing the transfer aperture B operates in the following manner: It is first supposed that the process unit U is positioned in place within the main assembly of the copying machine, as shown in FIGS. 3 and 9. The cover 26 is forced to move in the direction of arrow N through the levers 22 and 23 under the action of the springs 24 and 25. Since the slide member 27 engages with the latch member 33 without movement in the groove 17*d*$_1$, however, the cover 26 is in its position retracted from the transfer aperture B. Thus, the aperture B is kept open. As the process unit U is pulled in the direction as shown by D in FIG. 4, the slide member 27 is moved within the guide groove 17*d*$_1$ in the direction of arrow M under the action of the springs 24, 25 while engaging with the latch member 33 (FIG. 9). The movement of the slide member 27 causes the cover 26 to move in the direction of arrow N under the action of the springs 24 and 25 (FIG. 3). As the slide member 27 reaches the end 17*d*$_5$ of the guide groove 17*d*$_1$, the cover 26 is positioned in its closed position shown by two-dot chain line (26) in FIG. 3 whereat the aperture B is completely closed to prevent the photosensitive member from being exposed to external light. Thereafter, the process unit U is further pulled in the direction of arrow D and then removed from the main assembly of the copying machine. The cover 26 also serves as a protector for preventing the photosensitive member from being damaged by any external matter through the aperture B. If it is desired to insert the process unit U into the main assembly of the copying machine and set it in place, the slide member 27 is engaged by the member 33 and then moved relative to the latch member 33 in the groove 17*d*$_1$ in the direction opposite to the direction M. As a result, the cover 26 is moved in the opposite direction. As the unit is set in place within the main assembly of the copying machine, the aperture B will be opened.

Figure 7:
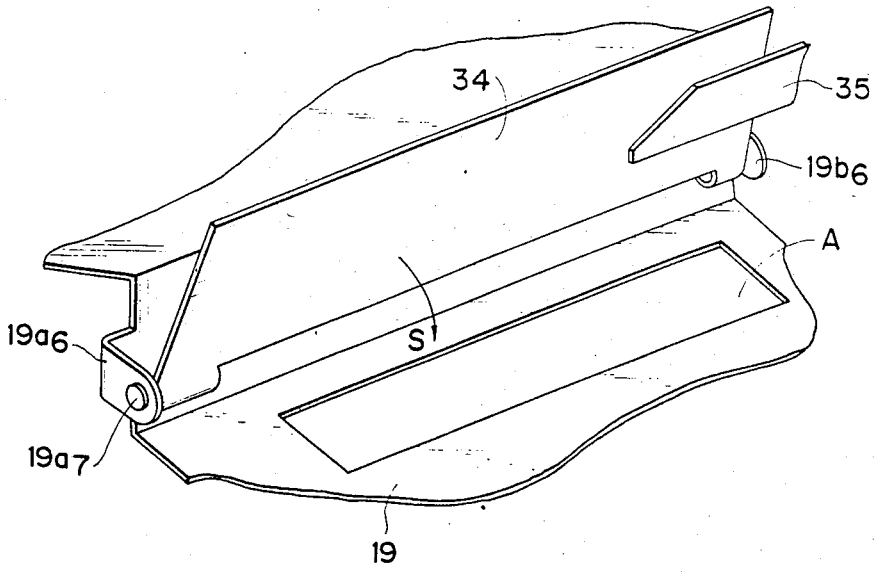

Next, the light blocking mechanism for closing the exposure aperture A which is formed in the plate-like member 19 will be described with reference to FIGS. 3, 5, 6 and 7. As can be understood from the previous description of the image forming process in the main assembly of the copying machine in connection with FIG. 1, the plate-like member 19 is provided with the aperture A for image exposure and blank exposure by the lamp Q as shown in FIGS. 5 and 7. Further, the plate-like member 19 includes support points 19*a*$_6$ and 19*b*$_6$ formed therein which fixedly support shafts 19*a*$_7$ and 19*b*$_7$, respectively. On these shafts 19*a*$_7$ and 19*b*$_7$ there is rotatably mounted a cover 34 for closing the aperture A. The cover 34 is made of an opaque plastic or metal material. In such a state as shown in FIGS. 3 and 5, the cover 34 engages with the upper face of the plate-like member 19 to close the aperture A so that the photosensitive member can be protected from external light. If the process unit U is inserted into the main assembly of the copying machine in the direction (D') opposite to the direction D (FIG. 4) as shown in FIG. 6 after the replacement of the development device 5, the drum 3 or others has been performed in the process unit, a slope portion 34$_1$ formed in the end of the cover 34 will ride on the corresponding slope portion on the guide member 35 which is fixed on the main assembly of the copying machine. As the process unit U is further moved in the main assembly of the copying machine, the slope portion 34$_1$ is guided by the guide member 35 so that the cover 34 will begin to rotate about the shafts 19*a*$_7$ and 19*b*$_7$ as a whole. When the process unit is finally set in place within the main assembly of the copying machine, the cover 34 rides and stops on the guide member 35 to completely open the aperture A. In such a state, the image exposure of the optical system 2 and the blank exposure of the lamp Q has become possible. When the process unit U is removed from the main assembly of the copying machine X, the cover 34 is moved inversely. When the slope portion 34$_1$ is moved away from the guide member 35, the cover 34 is pivoted in the direction S under gravity to return to such a position as shown in FIGS. 3 and 5, so that the aperture A will completely be closed before the unit U is removed from the main assembly. Therefore, the drum 3 will not be exposed to external light and not damaged by any external matter through the aperture A. The cover 34 may be biased in the direction S under the action of suitable spring means.

Figure 8:
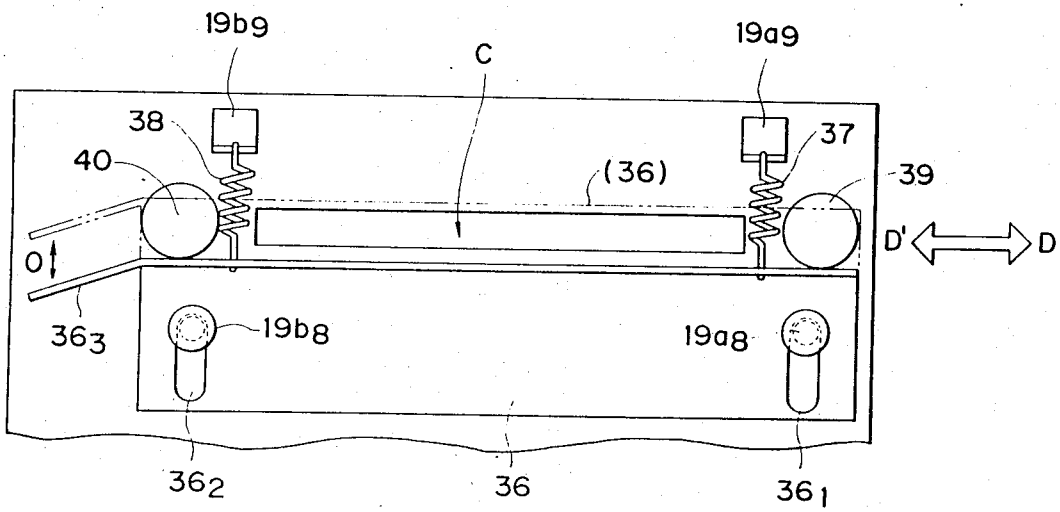

The light blocking mechanism for the aperture C formed in the plate-like member 19 for allowing pre-exposure of the photosensitive member will be described with reference to FIGS. 1, 3, 5 and 8. A cover 36 of an opaque plastic or metal material is slidably placed on the plate-like member 19. The cover 36 is provided with slots 36$_1$ and 36$_2$ into which guide pins 19*a*$_8$ and 19*b*$_8$ on the plate-like member 19 are loosely fitted, respectively. Thus, the cover 36 can slide in the direction of arrow O to close and open the aperture C as shown in FIG. 8. Springs 37 and 38 are respectively stretched between the cover 36 and spring hooks 19*a*$_9$ and 19*b*$_9$ on the plate-like member 19 to bias the cover 36 to its closed position in which the aperture C is closed. In such an arrangement, the cover 36 is positioned in such a location as shown by two-dot chain line in FIGS. 3, 5 and 8, so that it closes the aperture C on the plate-like member 19 to prevent the photosensitive member from being exposed to external light. As in the aperture B, the slope portion 36$_3$ formed in the end of the cover 36 is guided by guide members 39 and 40 (FIGS. 1 and 8) fixedly secured to the main assembly of the copying machine as the process unit U is being inserted into the main assembly in the direction D' after the replacement of the development device 5, the drum 3 or others has been performed in the process unit. As shown in FIG. 8, the cover 36 is moved, from its closed position shown by two-dot chain line in which the aperture C is closed, to its open position in which the aperture C is opened. When the process unit U is set in place within the main assembly of the copying machine, the cover 36 becomes stationary in such a state that the aperture C is completely opened as shown by solid line. In such a state, the pre-exposure of the photosensitive member becomes possible. In this connection, FIG. 1 shows the aperture C opened. When it is desired to remove the process unit U from the copying machine, the cover 36 is inversely moved. When the cover 36 is disengaged from the guide member 39, the cover 36 is returned to such a position as shown in FIGS. 3 and 5 under the action of the springs 37 and 38, so that the aperture C will completely be closed before the unit U is removed from the main assembly. As a result, the drum 3 will not be exposed to external light and also not damaged by any external matter through the aperture C.

In the aforementioned embodiments, the light blocking mechanisms are provided on the plate-like member which functions to hold the charger. Thus, the mechanism will have a plurality of functions, i.e. for holding the charger, for holding the drum and for blocking external light to the drum through the apertures. This means that the process unit can be reduced in size. Further, the light blocking mechanisms are so simplified in construction that any failure in operation can be prevented and the process unit can inexpensively be manufactured with smaller size and weight, resulting in easy handling of the process unit.

As has been previously described, there is also a process unit of such a type that it can be drawn out of and held outside of, the main assembly of the copying machine, other than the type described in the previous embodiments. In such an arrangement, the guide members 17*e* and 17*f* on the process unit are respectively engaged by the positioning member 18*a* and 18*b*, and stoppers are provided on the sides of the positioning members 18*a* and 18*b*. Thus, the process unit will not be completely removed from the main assembly of the copying machine. This arrangement is different from the previously described embodiments only whether or not the process unit can completely be removed from the copying machine. Therefore, there is no essential difference between the illustrated embodiments and the just mentioned arrangement. The above light blocking mechanisms may easily be applied to the latter.

Figure 10:
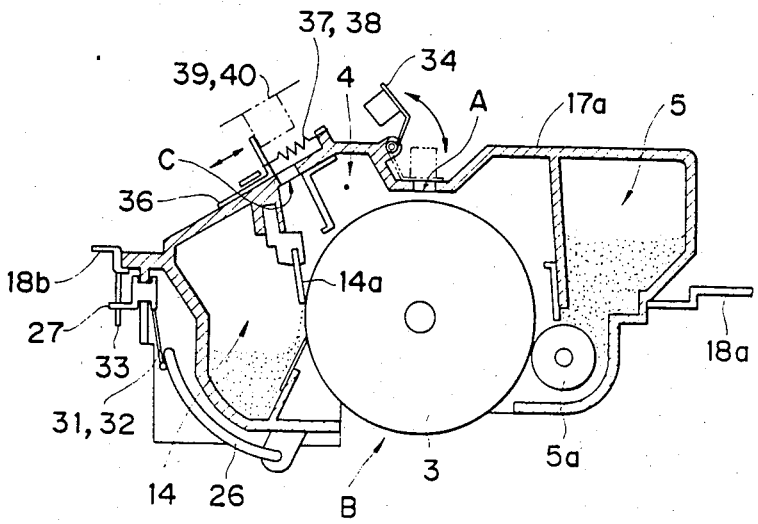
FIG. 10 is a cross-sectional view of one form of a cartridge type process unit according to the present invention.

FIG. 10 shows another embodiment of the present invention in which the process unit is of a cartridge type that the photosensitive member and process means are integrally mounted in the process unit, different from the previous embodiments in which the photosensitive member and process means are detachably mounted in the process unit. In the process unit shown in FIG. 10, it can be replaced as a whole as when the drum is to be replaced, when the previous process unit is to be replaced by another process unit having a different colored toner contained therein and so on. The process unit comprises the drum 3 having a photosensitive layer applied to the surface thereof, the charger 4, the development device 5 and the cleaner 14 all of which are contained as a unit in a mold housing 17*a*. Similarly, the exposure and transfer apertures A, B and C are formed in the process unit. Therefore, similar measures for closing the apertures are required when the process unit is removed from the main assembly or before the process unit is set in the main assembly of the copying machine. A light blocking mechanism for closing the transfer aperture B which can be used in the embodiment of FIG. 10 is similar to that of the previous embodiments. On the other hand, a light blocking mechanism for closing the image exposure apertures A and C is also similar to that of the previous embodiments, but, in the embodiment of FIG. 10, the light blocking mechanism for the apertures A and C is mounted on a molded housing 17'. The effects of the light blocking mechanism is the same as with the foregoing so that further description of the effects of these light blocking mechanisms will be omitted.

Although both the slidable and pivotable covers have been described as to the closure of the exposure apertures, one of these covers may be used throughout the process unit. The covers are preferably made of metal, resin, rubber or the like. However, it may be made of any opaque material. Moreover, the covers may be made of a filter material that can block a light having such a wavelength as to adversely affect the photosensitive member or a material that can reduce external light up to such a degree as not to adversely affect the photosensitive member. In the present Specification, such filter and light-reducing materials is intended to be the light-blocking material.

Figure 11A:
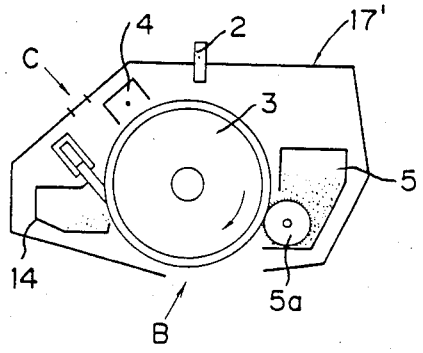
FIGS. 11A to 11F illustrate various other forms of process units to which the present invention can be applied.
Figure 11B:
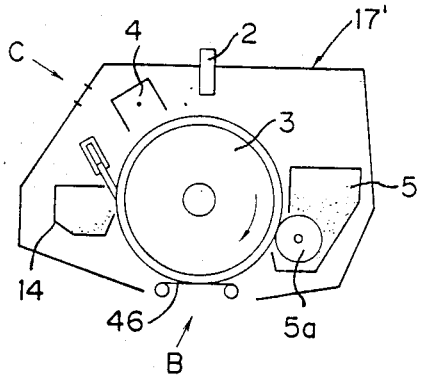
Figure 11C:
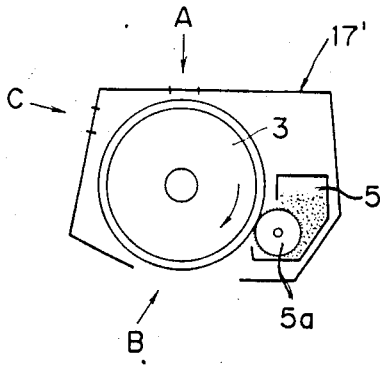
Figure 11D:
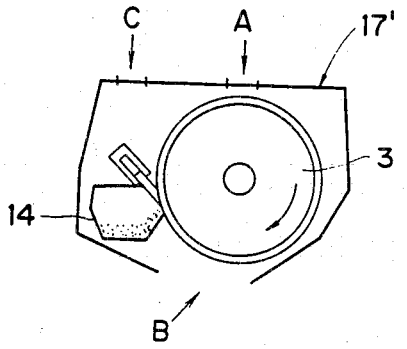
Figure 11E:
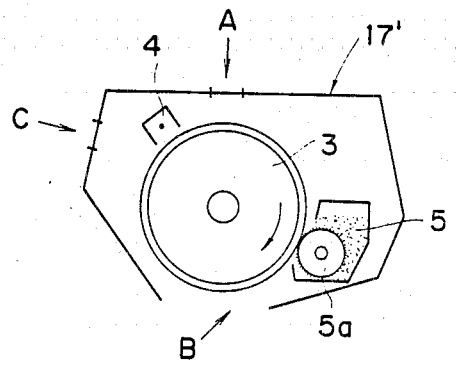
Figure 11F:
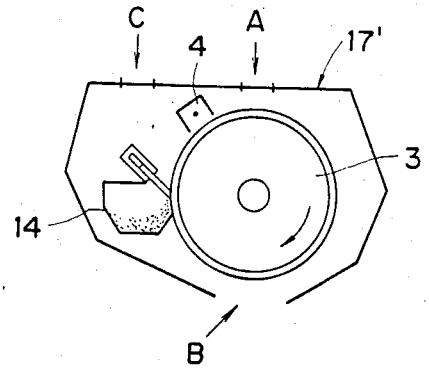

The present invention can be applied to electrophotographic systems of such a type that an electrophotographic type photosensitive member is exposed to the light from a laser beam or light emission diode in accordance with electric signals, in addition to the conventional copying machines. There are also such process units as shown in FIG. 11 other than these embodiments. In any event, the apertures will be closed by a mechanism similar to that of the previous embodiments when the process unit is removed from the main assembly of the copying machine. FIG. 11A shows a structure in which the imaging lens 2 is added to the embodiment of FIG. 10: FIG. 11B shows a structure in which the lens 2 and separating means (separating belt 46 are added to the embodiment of FIG. 10: FIG. 11C shows a structure in which a cleaner for cleaning the charger is omitted from the embodiment of FIG. 10: FIG. 11D shows a structure in which the charger and development device are omitted from the embodiment of FIG. 10: FIG. 11E shows a structure in which a cleaner is omitted from the embodiment of FIG. 10: and FIG. 11F shows a structure in which the development device is omitted from the embodiment of FIG. 10. Alternatively, a charge removing corona discharger may be disposed below the cleaner. In any event, the process unit may includes at least one process means in addition to the photosensitive drum. The process units shown in FIG. 11 may be of a cartridge type.

The actuation of a light blocking member for preventing the photosensitive member from being exposed to external light, for preventing the photosensitive member from being damaged or for preventing any external matter from penetrating into the process unit is thus associated with the movement of the process unit when it is set in or removed from the main assembly of the electrophotographic system. As a result, the light-blocking can automatically be performed and yet is completed at the same time as the process unit is removed from the main assembly such that the photosensitive drum will be exposed for no or very short time. Accordingly, the photosensitive member can be protected against any adverse affection of external light.

A further embodiment of the present invention will be described. In such a further embodiment, the drum 3 can be removed from the process unit U only after the development device 5 has been removed from the unit U. Accordingly, the drum 3 can be protected against any damage which may occur when the drum 3 is inadvertently to be removed from the process unit U prior to the removal of the development device 5.

The arrangement of this embodiment is the same as in the previous embodiments except its additional components and the elements $\mathbf{19}a_{10}$ and 5*f* shown by twodot chain line in FIGS. 3 and 5.

In this embodiment, the plate-like member 19 includes a substantially S-shaped projection $\mathbf{19}a_{10}$ which extends from the bottom of the plate-like member downwardly toward the development device 5. The tip of this member $\mathbf{19}a_{10}$ engages with an abutment member 5*f* positioned thereabove and provided on the housing 5*c* of the development device 5 in such a position that the abutment member 5*f* will not interfere with a closure 5*d* of the development device 5 when the closure 5*d* is rotated about the shaft 5*e* to its open position. Even if the plate-like member 19 is to be rotated or removed upwardly for removing the drum 3 from the process unit U while the development device 5 is being in the process unit U, the plate-like member 19 cannot be retracted upwardly from the drum 3 by the engagement of the projection $19a_{10}$ with the abutment member 5*f*. Therefore, the drum 3 cannot be removed from the process unit U.

In order to remove the drum 3 from the process unit U, it is required that the development device 5 is first removed from the process unit U to bring the abutment member 5*f* out of engagement with the projection $19a_{10}$.

Figure 12:
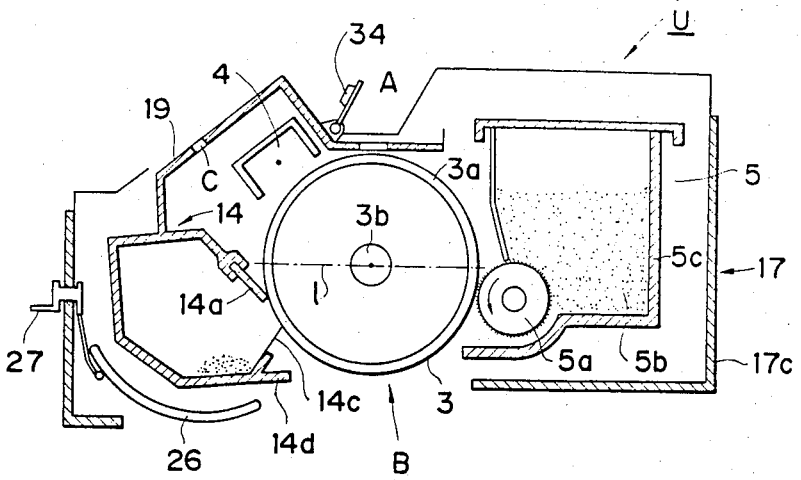
FIG. 12 is a cross-sectional view showing an other embodiment of the process unit according to the present invention.

A further embodiment of the present invention is shown in FIG. 12. In this embodiment, the drum 3 can be removed from the process unit U without any damage thereto while the process means including the development device 5, the cleaner 14 and others remain positioned on or near the periphery of the drum 3.

In this embodiment, the development. region by the magnet roller 5*a* and the cleaner region by the blade 14*a* are disposed below the center of the drum shaft 3*b* (below a substantially horizontal line passing through the center of the drum shaft 3*b*). Even if the magnet roller 5*a* and blade 14*a* are positioned in contact with or near the periphery of the drum 3, the drum 3 can be prevented from being damaged by the magnet roller 5*a* and/or the blade 14*a* when the drum 3 is removed from the process unit U.

Figure 13:
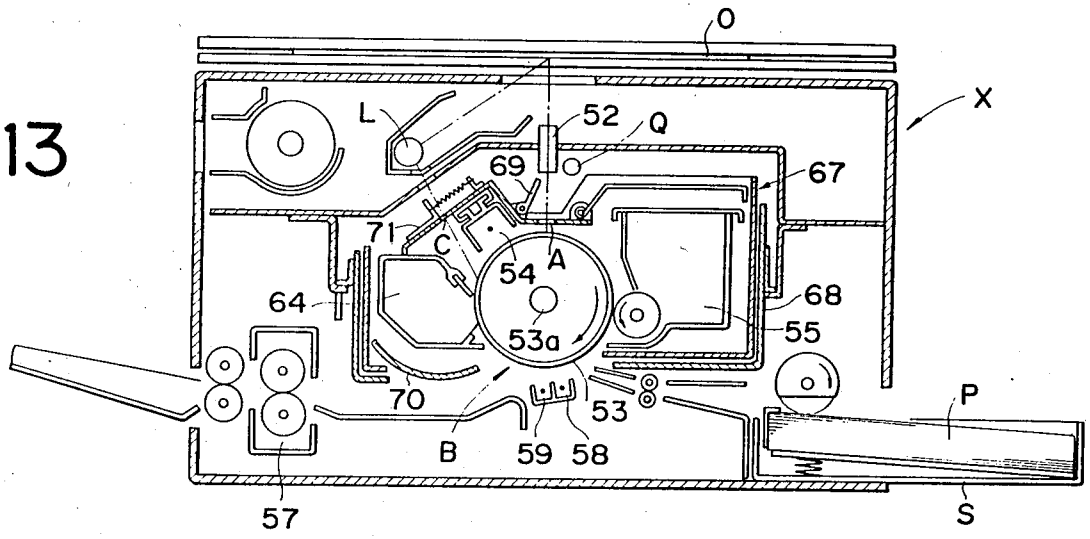
FIG. 13 is a cross-sectional view of a further embodiment of the present invention which is applied to an electrophotographic copying machine.

A further embodiment of the present invention will be described in which a process unit is mounted into the main assembly of a copying machine. FIG. 13 is a cross-sectional view of a copying machine to which this embodiment is applied.

In FIG. 13, reference numeral 53 denotes a photosensitive drum rotatable about a shaft 53*a* in the direction of arrow. Reference numeral 52 designates an array of short-focus lenses 54 a primary charger; 55 a development device; 58 a transfer charger; 59 a separation charger; 57 a fixation device; and 64 a cleaner. These components are used to form the image of an original O on a transfer material P which has been fed from a transfer material container S.

Among these components, the photosensitive drum 53, the charger 54, the development device 55 and the cleaner 64 are contained in a process unit 67 as aforementioned.

In such a state as shown in FIG. 13, the process unit 67 is supported directly by the main assembly X in the engagement of a pin with an opening which will be described hereinafter in detail. Thus, the process unit 67 is placed in disengagement with a holding frame 68 to form a gap therebetween.

Figure 14:
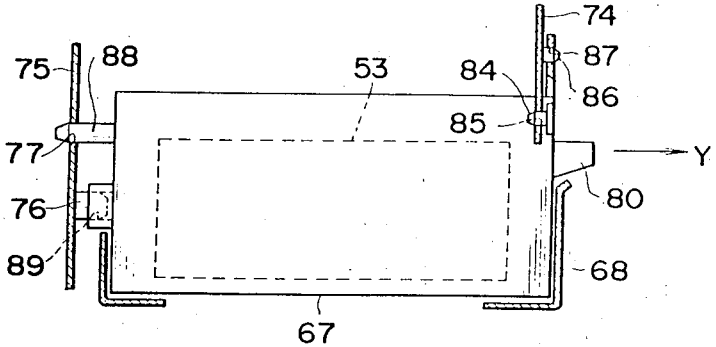
FIG. 14 is a view showing the engagement between the process unit and the main assembly of the machine.

As shown in FIG. 14, the process unit 67 is spaced from the holding frame 68 when the unit is set in place within the main assembly X. Consequently, the process unit 67 is positioned directly by the chassis of the main assembly X. A tapered pin 84 on the front wall of the process unit 67 is fitted into a positioning hole 85 formed in the front wall 74 of the main assembly chassis. A tapered pin 86 on the front wall 74 of the chassis is fitted into a positioning hole 87 on the front wall of the process unit. Even at the opposite side, a pin on the rear wall of the unit is fitted into a hole 88 on the rear wall of the chassis while a pin 76 on the rear wall 75 of the main assembly chassis is fitted into a hole 39 on the rear wall of the process unit 67. Thus, the process unit 67 is positioned by these pins.

When an operator pulls a handle 80 on the forward portion of the process unit 67 in the direction of arrow Y, the process unit 67 can be drawn out of the main assembly while being held by the holding frame 68.

Figure 16:
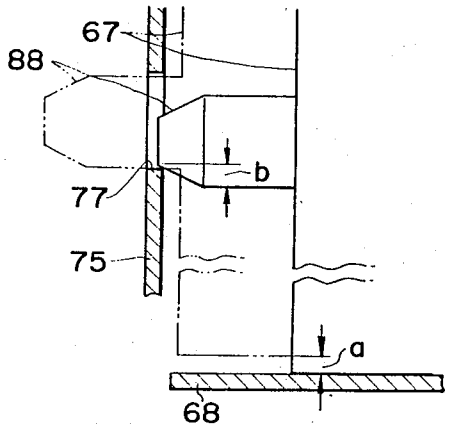
FIG. 16 is a fragmentary view illustrating a relationship between a tapered pin and an aperture into which the pin is to be inserted.

FIG. 16 shows the details of such an engagement relationship. In FIG. 16, solid line depicts such a state that upon the insertion into the main assembly, the process unit 67 is still held by the holding frame 68 immediately before the pin 88 engages in the hole 77. Chain line depicts the process unit 67 that has been held within the main assembly by engaging the pin 88 with the hole 77. In such a state as shown by chain line, therefore, the process means outside the process unit are in a proper positional relationship with the process unit. Assuming that the process unit is lifted by a distance a from a position in which the process unit is held by the holding frame 68 to the position in which the process unit is held by the main assembly X, the pin 88 is positively fitted into the hole 77 when the process unit 67 is forced into the main assembly X, if a thickness b in the tapered section of the pin 88 is slightly larger than the distance a. The lateral dimensions are similarly determined.

Figure 15:
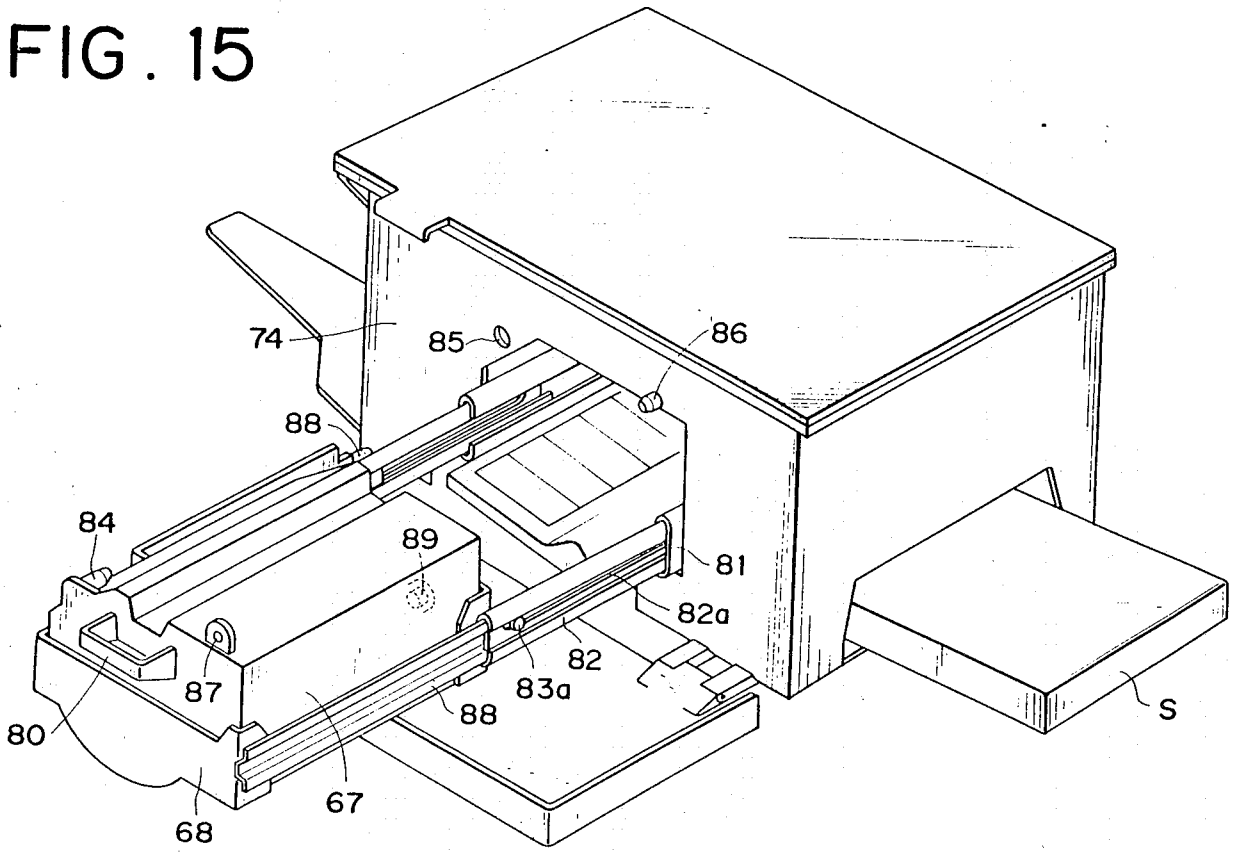
FIG. 15 is a perspective view illustrating the process unit of FIG. 14 which has been drawn out.

FIG. 15 is a perspective view of the process unit 67 which has been drawn out of the main assembly. The engagement of the holding frame 68 with the main assembly is accomplished by movable and stationary rails 82 and 83. Each of the movable rails 82 is hollow and loosely fitted into a rail guide frame 81 fixed to the main assembly X. Each of the stationary rails 83 is loosely fitted into the hollow portion of the corresponding movable rail 82 and fixed to the holding frame 68. When the holding frame 68 is moved forwardly or rearwardly, the rails are slidably moved relative to one another. Each of the rails 82 includes an elongated slot 82*a* formed therein along the length thereof. A pin 83*a* attached to the corresponding rail 83 and a pin attached to the corresponding guide frame 81 (not shown) is engageable in the elongated slot 82*a* to provide a stopper when the process unit is pulled to a position shown in FIG. 15.

During the operation of the copying machine (FIG. 13), the process unit is positioned such that an optical path from the light source Q and the lens 52 faces the aperture A; the charging region of the chargers 58 and 59 faces the aperture B; and an optical path from the light source L faces to the aperture C. In association with the drawing of the process unit 67, the aperture A is closed by a closure 69 which is rotatable clockwise; the aperture C is covered by a close 71 movable rightwardly and upwardly along the upper lid 72; and the aperture B is closed by a covering 70.

In this embodiment of the electronic copying machine, when the process unit is pulled, the tapered pins and holes on the main assembly chassis and process unit 67 are moved relative to one another to gradually move the process unit 67 downwardly to a position in which the positioning and holding condition is released. At this time, the process unit 67 is gently held by the holding frame 68 without any impact so that the process unit can safely and positively be drawn out of the main assembly. In order to insert the process unit 67 in the main assembly X, the process unit 67 is simply forced into the main assembly on the holding frame 68 so that the tapered pins are fitted into the respective holes because of the dimensional relationship therebetween as shown in FIG. 15 and described herein before. As a result, the process unit can accurately be set in place within the main assembly. Since the series of operations are automatically performed, an ordinary user can replace the process unit properly without the aid of an expert serviceman.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus, wherein said unit guide means includes a receiving portion for detachably supporting the process unit, wherein said process unit is adapted to be detached from said unit guide means when in an outside position;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means.

2. An image forming apparatus as defined in claim 1, wherein said unit guide means includes movable rails.

3. An image forming apparatus as defined in claim 1, wherein said process means is independently detachable from said process unit.

4. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means, wherein said positioning members are provided with positioning holes.

5. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and unit, engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means, wherein said engageable members include tapered pins.

6. An image forming apparatus as defined in claim 5, wherein said process means includes a development device for developing an image on said image bearing member.

7. An image forming apparatus as defined in claim 5, wherein said process means includes a cleaner for cleaning said image bearing member.

8. An image forming apparatus as defined in claim 5, wherein said process means includes a corona charger for applying corona discharge onto said image bearing member.

9. An image forming apparatus as defined in claim 5, wherein said process means includes an array of short-focus and small diameter imaging elements for forming an image on said image bearing member.

10. An image forming apparatus as defined in claim 5, wherein said process means includes an array of short-focus and small-diameter imaging elements for forming an image on said image bearing member, a development device for developing an image on said image bearing member and a cleaner for cleaning said image bearing member.

11. An image forming apparatus as defined in claim 5, wherein said process means includes a charger for applying corona discharge onto said image bearing member and a development device for developing an image on said image bearing member.

12. An image forming apparatus as defined in claim 5, wherein said process means includes a charger for applying corona discharge onto said image bearing member and a cleaner for cleaning said image bearing member.

13. An image forming apparatus as defined in claim 5, wherein said process means includes a corona charger for applying corona discharge onto said image bearing member, a development device for developing an image on said image bearing member and a cleaner for cleaning said image bearing member.

14. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means, wherein said unit guide means includes a receiving portion for detachably supporting said process unit, wherein said process unit is detachable when it is moved to its outside position by said guide means.

15. An image forming apparatus as defined in claim 14, wherein said process means is independently detachable from said process unit.

16. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means, wherein said positioning members are provided with positioning holes.

17. An image forming apparatus as defined in claim 16, wherein said process means includes a development device for developing an image on said image bearing member.

18. An image forming apparatus as defined in claim 16, wherein said process means includes a cleaner for cleaning said image bearing member.

19. An image forming apparatus as defined in claim 16, wherein said process means includes a corona charger for applying corona discharge onto said image bearing member.

20. An image forming apparatus as defined in claim 16, wherein said process means includes an array of short-focus and small-diameter imaging elements for forming an image on said image bearing member.

21. An image forming apparatus as defined in claim 16, wherein said process means includes an array of short-focus and small-diameter imaging elements for forming an image on said image bearing member, a development device for developing an image on said image bearing member and a cleaner for cleaning said image bearing member.

22. An image forming apparatus as defined in claim 16, wherein said process means includes a charger for applying corona discharge onto said image bearing member and a development device for developing an image on said image bearing member.

23. An image forming apparatus as defined in claim 16, wherein said process means includes a charger for applying corona discharge onto said image bearing member and a cleaner for cleaning said image bearing member.

24. An image forming apparatus as defined in claim 16, wherein said process means includes a corona charger for applying corona discharge onto said image bearing member, a development device for developing an image on said image bearing member and a cleaner for cleaning said image bearing member.

25. An image forming apparatus, comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means;

wherein said process unit is supported without being fixed to said guide means, and said process unit is moved relative to said guide means by engagement between said positioning member and said engaging member.

26. An image forming apparatus as defined in claim 25, wherein said unit guide means includes a receiving portion for detachably supporting said process unit, and wherein said process unit is detachable when it is moved to its outside position by said guide means.

27. An image forming apparatus as defined in claim 26, wherein said process means is independently detachable from said process unit.

28. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members is provided on said process unit at its front side and rear side with respect to the direction of movement of said unit guide means, wherein said positioning members are provided with tapered pins.

29. An image forming apparatus comprising:

unit guide means for supporting a process unit including an image bearing member and process means for acting on said image bearing member, said guide means being movable between an inside position wherein the image bearing member is opposed to optical means to receive image information therethrough and an outside position wherein the guide means is projected out of the apparatus;

members for positioning said process unit in said apparatus; and engaging members provided in said process unit, engageable with said positioning members to correctly position said process unit in said apparatus when said unit guide means supporting said process unit is moved into said apparatus, wherein said engageable members are provided on said process unit at its front side and rear side with respect to the direction of movement of said unit guide means, wherein said process unit is supported without being fixed to said guide means.

30. An image forming apparatus as defined in claim 29, wherein said process means is independently detachable from said process unit.

* * * * *

UNITED STATES PATENT AND TRADEMARK OFFICE

CERTIFICATE OF CORRECTION

PATENT NO. : 4,708,455

DATED : November 24, 1987

INVENTOR(S) : ATSUSHI KUBOTA, ET AL.

It is certified that error appears in the above-identified patent and that said Letters Patent is hereby corrected as shown below:

COLUMN 1

Line 51, "the selecting" should read --selecting the--.
Line 62, "are still remained." should read --still remain.--

COLUMN 2

Line 44, "an other" should read --another--.

COLUMN 3

Line 7, "a" (first occurrence) should read --an--.

COLUMN 5

Line 59, "whol" should read --whole--.

COLUMN 6

Line 39, "be" should read --been--.
Line 51, "expert" should read --exposed--.
Line 58, "experts" should read --an expert--.

UNITED STATES PATENT AND TRADEMARK OFFICE

CERTIFICATE OF CORRECTION

PATENT NO. : 4,708,455

DATED : November 24, 1987

INVENTOR(S) : ATSUSHI KUBOTA, ET AL.

It is certified that error appears in the above-identified patent and that said Letters Patent is hereby corrected as shown below:

COLUMN 7

Line 24, "spring" should read --springs--.

COLUMN 8

Line 1, "spcific" should read --specific--.
Line 50, "pin" should read --pins--.
Line 58, "amd" should read --and--.

COLUMN 10

Line 16, "not damaged" should read --not be damaged--.

COLUMN 11

Line 16, "member" should read --members--.
Line 21, "only whether" should read --only as to whether--.
Line 55, "17'." should read --17a.--.

COLUMN 12

Line 16, "FIG. 10:" should read --FIG. 10;--.
Line 17, "46 are" should read --46) are--.
Line 18, "FIG. 10:" should read --FIG. 10;--.
Line 20, "FIG. 10:" should read --FIG. 10;--.
Lines 22-23, "FIG. 10:" should read --FIG. 10;--.
Line 24, "FIG. 10:" should read --FIG. 10;--.
Line 29, "includes" should read --include--.
Line 56, "twodot" should read --two-dot--.

UNITED STATES PATENT AND TRADEMARK OFFICE

CERTIFICATE OF CORRECTION

PATENT NO. : 4,708,455

DATED : November 24, 1987

INVENTOR(S) : ATSUSHI KUBOTA, ET AL.

It is certified that error appears in the above-identified patent and that said Letters Patent is hereby corrected as shown below:

COLUMN 13

Line 21, "line passing" should read --line 1 passing--.
Line 36, "lenses 54" should read --lenses; 54--.
Line 47, "in" should read --by--.
Line 62, "hole 88" should read --hole 77--.
Line 64, "hole 39" should read --hole 89--.

COLUMN 14

Line 47, "close 71" should read --closure 71--.
Line 65, "herein before." should read --hereinbefore.--.

COLUMN 15

Line 41, "apparatus" should read --apparatus,--.
Line 62, "apparatus" should read --apparatus,--.

COLUMN 16

Line 4, "unit," should be deleted.
Line 28, "small diameter" should read --small-diameter--.
Line 53, "apparatus" should read --apparatus,--.

COLUMN 17

Line 12, "apparatus" should read --apparatus,--.

UNITED STATES PATENT AND TRADEMARK OFFICE

CERTIFICATE OF CORRECTION

PATENT NO. : 4,708,455

DATED : November 24, 1987

INVENTOR(S) : ATSUSHI KUBOTA, ET AL.

It is certified that error appears in the above-identified patent and that said Letters Patent is hereby corrected as shown below:

COLUMN 18

Line 36, "apparatus" should read --apparatus,--.
Line 53, "is" should read --are--.
Line 58, "apparatus" should read --apparatus,--.

Signed and Sealed this

Twenty-eighth Day of February, 1989

*Attest:*

DONALD J. QUIGG

*Attesting Officer*

*Commissioner of Patents and Trademarks*